US005622283A

United States Patent [19]

Morrison

[11] Patent Number: 5,622,283

[45] Date of Patent: Apr. 22, 1997

[54] PAINT DISPENSING SYSTEM

[75] Inventor: Adam P. Morrison, Rockford, Ill.

[73] Assignee: The Testor Corporation, Rockford, Ill.

[21] Appl. No.: 381,549

[22] Filed: Jan. 31, 1995

[51] Int. Cl.[6] ..... B65D 35/28

[52] U.S. Cl. ..... 222/103; 222/107

[58] Field of Search ..... 222/92, 107, 103, 222/214, 562

[56] References Cited

U.S. PATENT DOCUMENTS

| | | |
|---|---|---|
| 103,640 | 5/1870 | Merritt . |
| 859,711 | 7/1907 | Winsor . |
| 1,094,974 | 4/1914 | Bradley . |
| 1,181,574 | 5/1916 | Crocker . |
| 1,306,830 | 6/1919 | Moore . |
| 1,475,116 | 11/1923 | Harvey . |
| 1,510,848 | 10/1924 | Hubbard . |
| 1,566,696 | 12/1925 | Reid . |
| 1,965,596 | 7/1934 | Kline . |
| 2,291,282 | 7/1942 | Hollenbeck . |
| 2,644,613 | 7/1953 | Pepin . |
| 2,751,072 | 6/1956 | Ditmar . |
| 2,830,396 | 4/1958 | Gowland . |
| 2,869,162 | 1/1959 | Dritz . |
| 2,893,710 | 7/1959 | Goodman . |
| 3,070,824 | 1/1963 | Martin . |
| 3,070,825 | 1/1963 | Martin . |
| 3,160,271 | 12/1964 | Ritter . |
| 3,223,289 | 12/1965 | Bouet . |
| 3,262,605 | 7/1966 | Madden et al. . |
| 3,341,884 | 9/1967 | Pryor . |
| 3,424,300 | 1/1969 | Penniman, Jr. . |
| 3,918,820 | 11/1975 | Kim . |
| 3,960,294 | 6/1976 | Bernard . |
| 4,370,989 | 2/1983 | Taylor . |
| 4,447,169 | 5/1984 | Vartoughian . |
| 4,484,827 | 11/1984 | Price, Jr. . |
| 4,496,354 | 1/1985 | Steer et al. . |
| 4,534,669 | 8/1985 | Heck et al. . |
| 4,572,691 | 2/1986 | Kirchhoff et al. . |
| 4,710,048 | 12/1987 | Vartoughian . |
| 4,775,256 | 10/1988 | Roth . |
| 5,000,350 | 3/1991 | Thomsen . |
| 5,000,602 | 3/1991 | Kim . |
| 5,067,635 | 11/1991 | Thomsen . |
| 5,099,997 | 3/1992 | Ooms et al. . |

*Primary Examiner*—Gregory L. Huson

*Attorney, Agent, or Firm*—Fay, Sharpe, Beall, Fagan, Minnich & McKee

[57] ABSTRACT

A paint pouch assembly includes a pair of facing sidewalls sealed along their periphery. A fitting has a fluid passage that terminates in an inlet disposed within a cavity of the pouch and the inlet faces outwardly toward one of the sidewalls. By depressing the sidewall over the opening, fluid can be regulated through the fitting. The collapsible pouch may be used in a number of different applications. It may be incorporated into a dispensing apparatus that uses a hinged presser member to urge paint through the fitting and out through a pivoting head received on the opposite end. Removable attachments can be secured to the head to provide for a fine marker, foam brush, etc. Alternatively, the collapsible pouch can be used with a well structure that is secured to an artist's palette.

15 Claims, 10 Drawing Sheets

PAINT DISPENSING SYSTEM

BACKGROUND OF THE INVENTION

This invention pertains to the art of dispensing systems and more particularly to a paint dispensing apparatus and a collapsible pouch or bag assembly. The invention is particularly applicable to a pouch having a fitting disposed at one end that is received in the dispensing apparatus. Through application of pressure, the dispensing apparatus squeezes paint from the pouch cavity through the outlet. Although the invention will be described with particular reference to this preferred embodiment, it will be appreciated that the invention has broader applications and may be-advantageously employed in related environments and applications.

Generally speaking, collapsible bags or pouches used for storing paint for use with a brush or other dispensing tip are known in the art. For example, U.S. Pat. Nos. 103,640; 1,475,116; 2,869,162; 2,893,710; 3,960,294; 3,070,824; 3,070,825; 3,918,820; and 5,000,602 generally describe and illustrate known arrangements. Some of these dispensing apparatus are intended for use in painting large surface areas as opposed to providing small amounts of paint as required by an artist or graphic designer. Moreover, these prior structures are relatively complex and limited to a particular end use.

Use of a collapsible pouch for storing the paint typically includes a valve structure to regulate fluid flow therefrom. Depending on the complexity of the valve, it often comprises a major portion of the overall cost of the system so that expensive valves are not desirable. A low cost, reliable valving arrangement is preferred that can be easily manipulated by a consumer until a cap is positioned in place over the outlet to prevent leakage from the pouch.

It is also desirable to provide a system that is convertible to a number of different dispensing nozzles or tips. Prior arrangements do not use the same paint supply pouch assembly for use as a fine tip marker, foam brush, broad tip marker, paint brush, pump spray, propellant-carried spray, or even in a painter's pallet. The prior art is not deemed to address this requirement for versatility. Additionally, known dispensing tips do not provide a reliable structure for dispensing a steady, continuous flow of paint to a brush tip.

SUMMARY OF THE INVENTION

The present invention contemplates a new and improved paint dispensing system that overcomes the above-referenced problems and others and provides a simple, easy to use collapsible paint bag that can be easily converted for a number of different uses.

According to a more limited aspect of the invention, the system includes a collapsible pouch defined by a pair of sidewalls that are sealed together along their periphery. A fitting is also sealed between the sidewalls and has an inlet disposed within the internal cavity of the pouch that communicates with an outlet passage. Preferably, the inlet terminates within a plane generally parallel to that of the sidewalls so that a user can easily depress one of the sidewalls over the inlet to regulate flow from the pouch.

According to another aspect of the invention, the dispensing apparatus includes a support surface receiving the pouch thereon. A head is pivotally mounted at one end of the support surface for receipt over the fitting. A pressing member is also mounted to the support surface and adapted for selective movement toward and away from the support surface to squeeze paint from the pouch.

In accordance with yet another aspect of the invention, the pressing member has a tapered configuration and is preferably formed from a resilient, compressible material to gradually urge paint from the pouch.

A principal advantage of the invention resides in the simplified construction for dispensing paint or other fluid from the collapsible pouch.

Another advantage of the invention resides in the versatility of the pouch and dispensing apparatus for use in a wide variety of applications.

Yet another advantage of the invention resides in the ease with which paint flow from the pouch can be regulated, and dispensed in a controlled manner to a brush tip.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in this specification and illustrated in the accompanying drawings which show.

DETAILED DESCRIPTION OF THE PREFERRED EMBODIMENT

Figure 1:
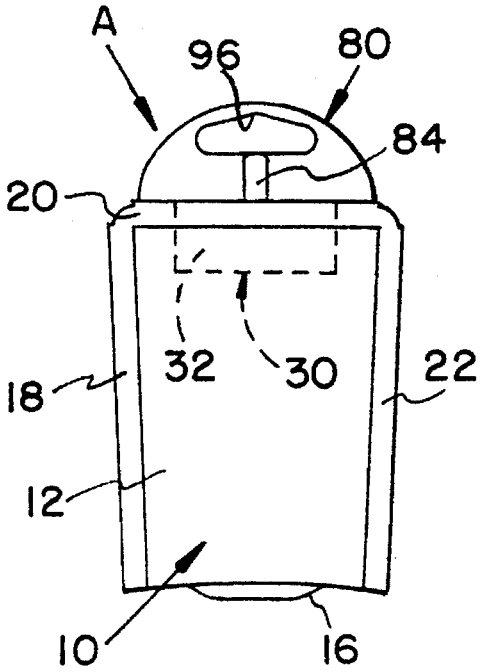
FIG. 1 is a front elevational view of a collapsible bag used to store paint.

Referring now to the drawings wherein the showings are for the purposes of illustrating the preferred embodiments of the invention only and not for purposes of limiting same, the FIGURES show a collapsible paint pouch or bag A used with a dispensing apparatus B in a wide variety of applications. More particularly, and with general reference to FIGS. 1–5, the collapsible pouch assembly includes a pouch 10 of generally rectangular configuration defined by a pair of planar sidewalls 12, 14 interconnected at a first or lower end 16. The remaining three sides of the rectangular pouch 18, 20, 22 are sealed together along peripheral portions thereof. According to the preferred arrangement, a heat seal is formed between the sidewalls along the peripheral edges since the collapsible pouch is formed from a single sheet of polyethylene. When the edges are heated, the polyethylene material of one sidewall fuses to the other sidewall in a manner generally well known in the art. The remaining portions of the sidewall remain unfused and can thereby expand and contract toward and away from one another so that fluid (paint) is reliably stored in the internal cavity. Eventually the paint is dispensed from the pouch as will be further described below.

Figure 6:
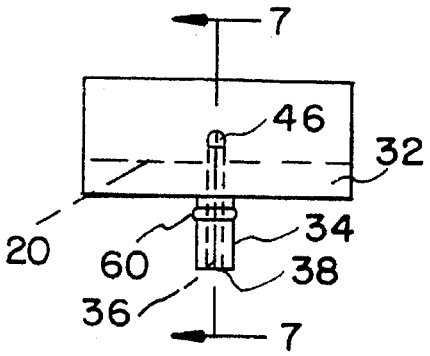
FIG. 6 is a front elevational view of a preferred fitting used in the collapsible paint pouch.
Figure 7:
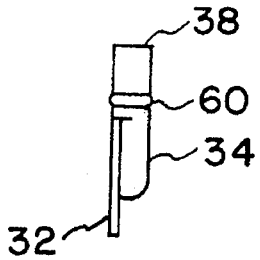
FIG. 7 is a side elevational view of the fitting of FIG. 6.
Figure 8:
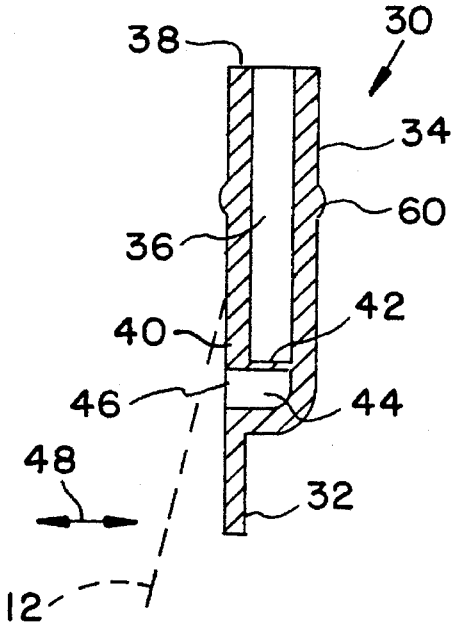
FIG. 8 is an enlarged, longitudinal cross-sectional view of the fitting of FIG. 6 taken generally along the lines 7—7.

Disposed in the second or upper edge 20 of the pouch is a fitting 30, also preferably formed of a polyethylene material. More particular details of the fitting are illustrated in FIGS. 6–8. The fitting has a planar portion 32 that is heat sealed between the peripheral edges of the first and second sidewalls. A generally tubular shaped housing 34 is mounted on one face of the planar portion 32 and defines a first passage 36 that is generally aligned with a central axis of the pouch, forming an outlet 38 at an upper or first end. A second or inner end 40 of the first passage is temporarily closed by a thin walled membrane 42 (FIG. 8). The membrane is designed to be easily pierced with a sharp object by a consumer when the pouch is ready for use. Once the membrane is breached, the first passage communicates with a second passage 44 which is oriented in generally perpendicular fashion to the first passage, and likewise substantially perpendicular to the planar portion 32 of the fitting. The second passage interconnects the internal cavity of the pouch with the outlet 38 through inlet 46 and the first passage. The inlet is formed in a plane substantially parallel to the sidewalls of the pouch. In this manner, sidewall 12, which is sealed to the face of the planar portion 32 that receives the inlet, can be easily depressed over the opening as represented by directional arrow 48 in FIG. 8. When advanced over the inlet, the sidewall 12 operates like a flap valve to selectively preclude dispensing of paint to the outlet.

Figure 2:
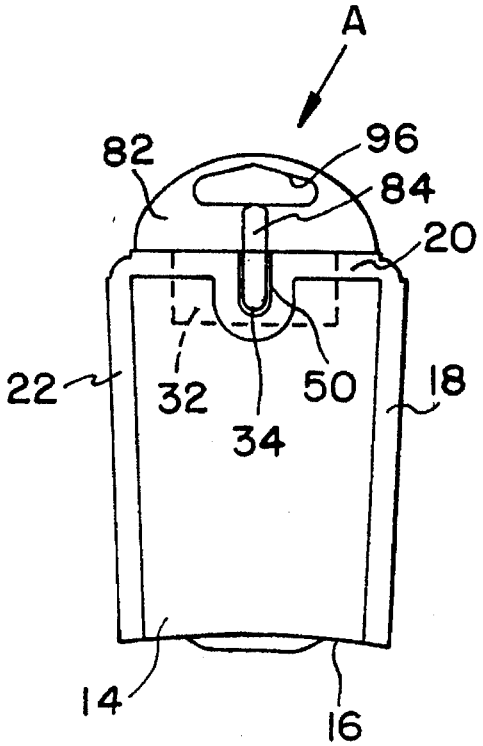
FIG. 2 is a rear elevational view of the collapsible bag of FIG. 1.
Figure 3:
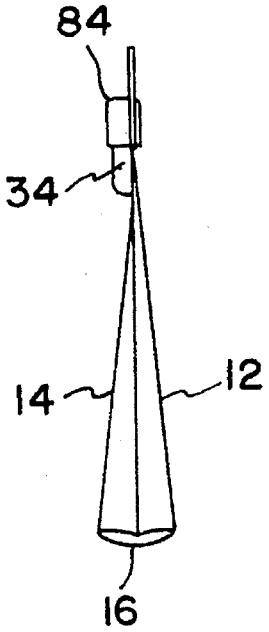
FIG. 3 is a side elevational view of an empty, collapsible bag.
Figure 4:
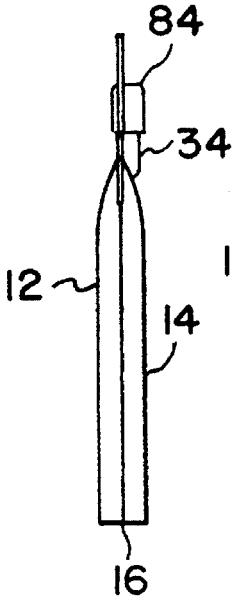
FIG. 4 is a side elevational view of the bag of FIG. 1 particularly illustrating its configuration when filled with paint.
Figure 5:
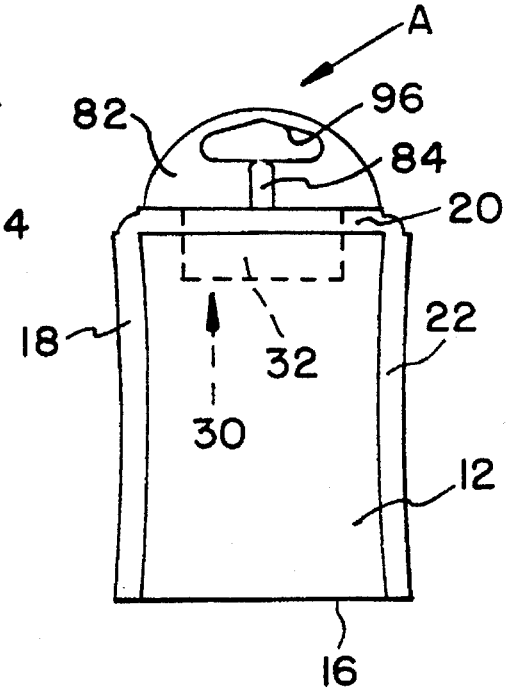
FIG. 5 is a front elevational view of the bag shown in FIG. 4.

As shown by dotted line in FIG. 6, the sidewall upper periphery 20 is heat sealed to the planar portion of the fitting at an area between the inlet 46 and outlet 38. Moreover, and as best shown in FIG. 2, the second sidewall 14 includes a recessed cutout 50 that accommodates the fitting housing 34. The sidewall 14 is fused along its second edge 20 to the planar portion of the fitting. In this manner, the pouch is sealingly secured along its periphery.

A raised rib 60 is disposed on an external surface of the fitting housing adjacent the outlet 38. Preferably, the raised rib is circumferentially continuous and cooperates with a circumferential groove formed in a cap, as will be described in greater detail below.

Figure 9:
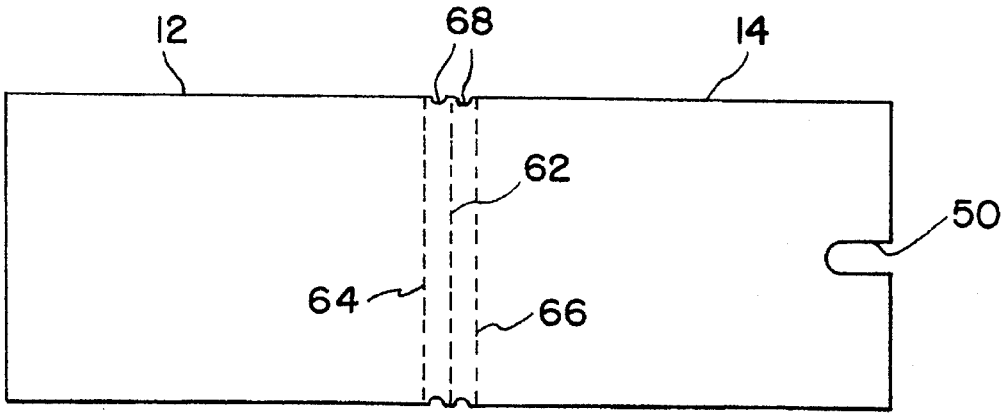
FIG. 9 is a plan view of a preferred blank used to form the collapsible bag.

FIG. 9 illustrates that the sidewalls are originally formed from a single piece blank having a series of fold or score lines 62, 64, 66. The score line 62 divides the blank into equal portions which become sidewalls 12, 14 while the closely spaced, parallel fold lines 64, 66 provide a pleat or bellows type configuration allowing the cavity of the pouch to be expanded and hold a greater amount of fluid therein. Cutouts 68 are provided on the peripheral edges of the blank between the fold lines to facilitate assembly of the pouch.

Figure 10:
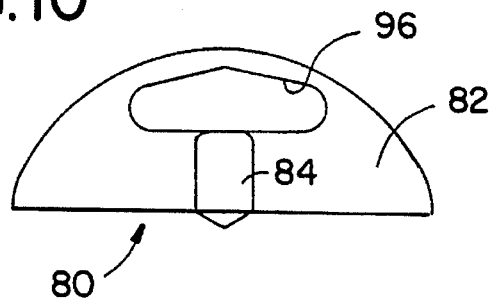
FIG. 10 is a plan view of a preferred cap that cooperates with the fitting.
Figure 11:
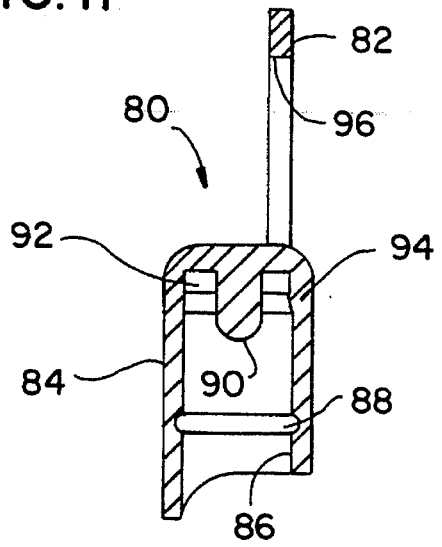
FIG. 11 is an enlarged cross-sectional view of the cap of FIG. 10.

With continued reference to FIGS. 1–5, and additional reference to FIGS. 10 and 11, a lid or cap 80 is shown that is adapted for closing receipt over the fitting housing 34. In the preferred embodiment, the lid has a planar portion 82 which is generally a semi-circular configuration. The diameter of the semi-circle is substantially equal to the length of the second edge of the pouch assembly to provide a continuous design to the planar shape of the pouch. Of course other configurations could be used without departing from the scope and intent of the subject invention. Mounted to one face of the lid planar portion is a housing 84 having a hollowed recess 86 adapted for sliding, interference fit over the outlet of the fitting. More particularly, the recess 86 includes a circumferentially continuous groove 88 that cooperates with the raised rib 60 on the fitting to removably lock the lid to the fitting. The recess also includes a sealing projection 90 that extends outwardly toward the open end of the recess defining an annular recess 92 that seals about the outlet of the fitting. Moreover, a tapered shoulder 94 reduces the cross section of the annulus so that the lid provides a tight, sealing fit over the outlet of the fitting.

Figure 12:
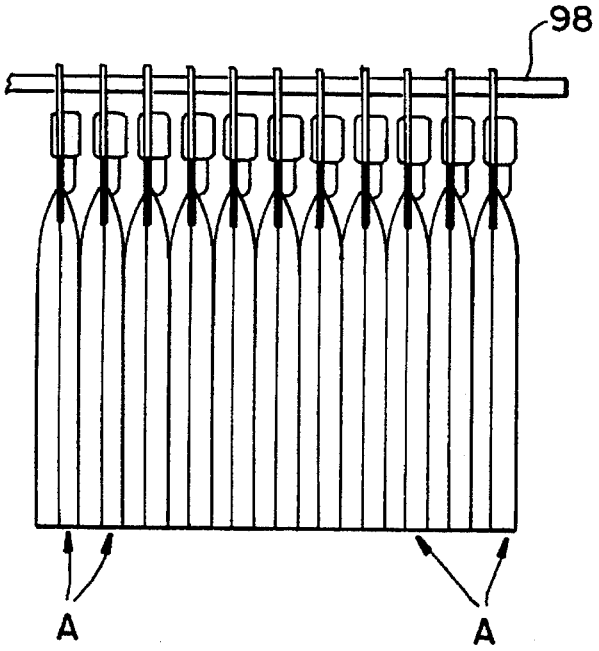
FIG. 12 is an elevational view showing a number of collapsible paint bags stored on a display unit.

The planar portion of the lid also includes an opening 96 that allows the lid to facilitate hanging the pouch in a display. As best shown in FIG. 12, a series of filled pouch assemblies are hung through openings 96 from an elongated rod 98 associated with a display unit (not shown). Of course, other display arrangements can be used and this merely illustrates one preferred arrangement for marketing the pouch assembly.

Figure 13:
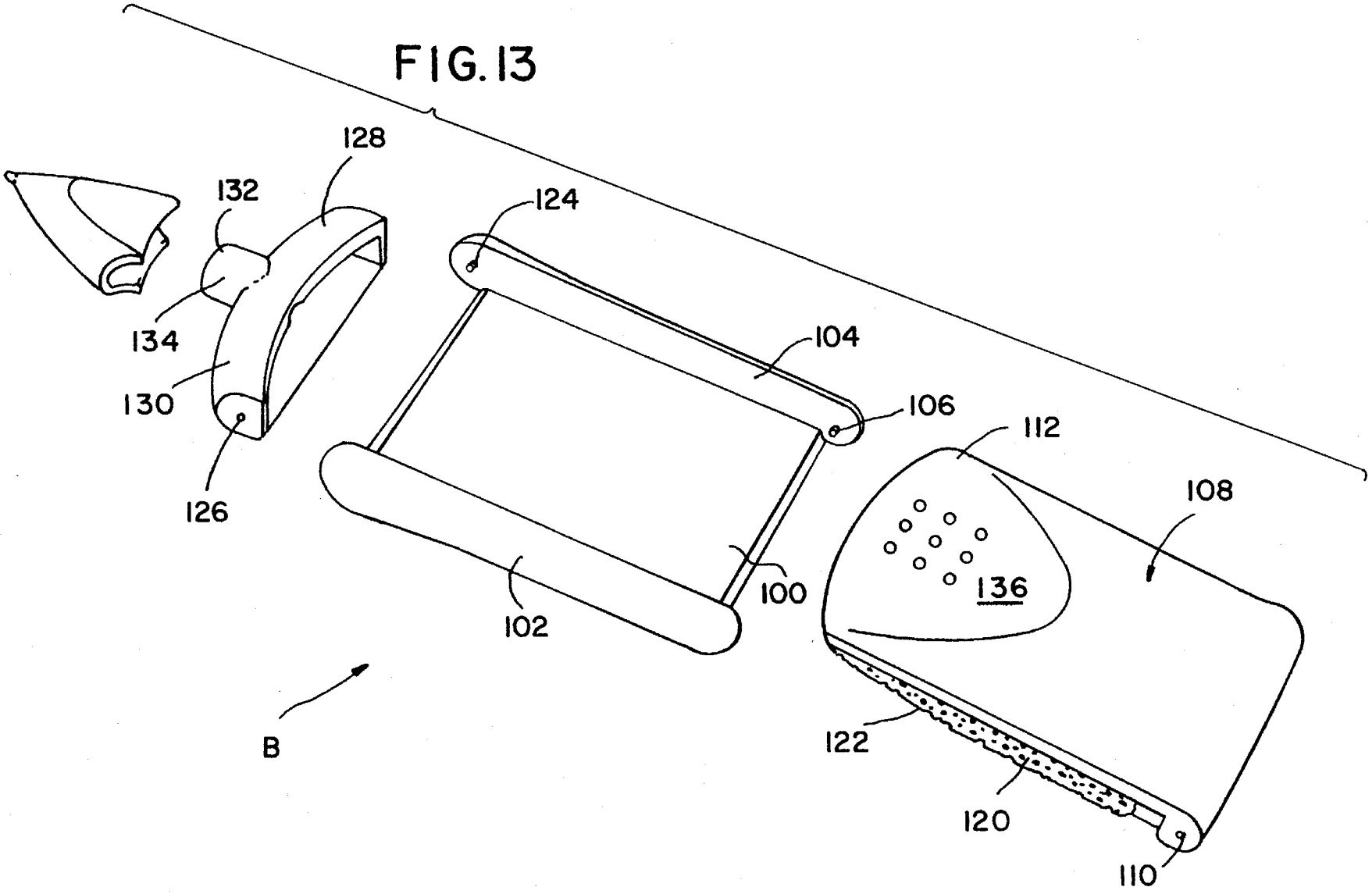
FIG. 13 is an exploded view of a preferred form of dispensing apparatus used with the collapsible pouches of FIGS. 1–12.

FIG. 13 shows a preferred form of dispensing apparatus used for the collapsible pouch assembly described above. The illustrated dispensing apparatus B includes a generally planar support surface 100 having a pair of spaced sidewalls 102, 104. The sidewalls have a height dimensioned to receive a completely filled pouch and provide lateral support thereto. At one end of the support surface, the sidewalls include small projections 106 that face one another and cooperate with a presser member 108, particularly recesses 110 formed in opposite sides of the presser member, to define a hinge connection. The presser member 108 is capable of rotation through approximately 180° so that a second end 112 thereof is disposed away from the support surface to allow loading of a pouch assembly onto the support surface.

In the preferred embodiment, the presser member includes a resilient, sponge-like or other compressible material 120 secured to an inner face. The compressible material also has a tapered configuration 122 that gradually urges the paint in the pouch toward the fitting opening upon continued depression of the presser member toward the support surface. In this manner, even if pressure is applied to the presser member at an area disposed away from the hinge, the compressible material will first contact the base of the pouch so that any fluid therein will be advanced toward the fitting.

At the opposite end of the support surface, a pair of projections 124 cooperate with recesses 126 in a pivotal head 128. Preferably, the head can move through approximately 90° so that it will not interfere with loading and unloading of a pouch assembly to and from the support surface. The head includes a cavity defined by wall 130 that supports the edge 20 of the collapsible pouch. Centrally disposed in the wall is an opening 132 adapted to closely receive the fitting therein. As shown in FIG. 13, the opening is formed as a generally hollow cylindrical extension 134 in the wall 130. This structure permits a number of various attachments to be used with the paint pouch as shown in FIGS. 14–18.

Figure 15:
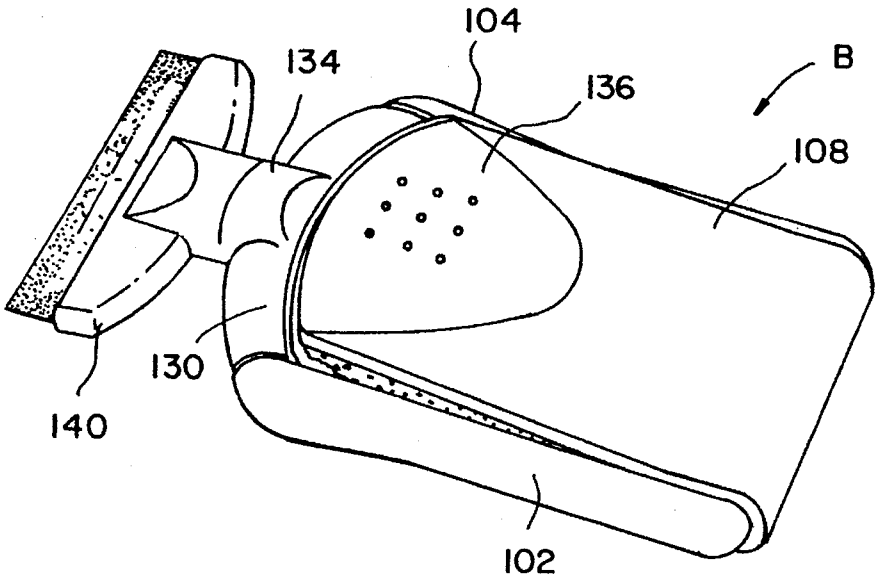
FIGS. 14–17 are alternative dispensing heads that may be used with the apparatus shown in FIG. 13.
Figure 14:
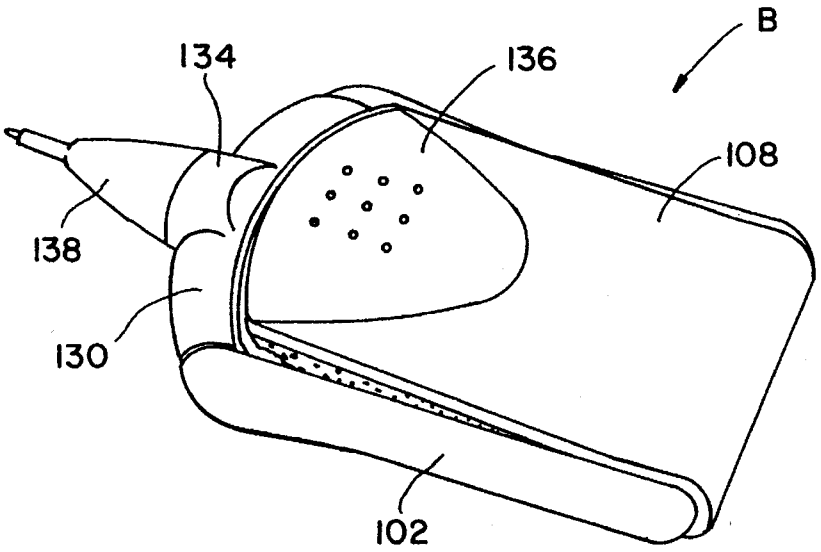
Figure 17:
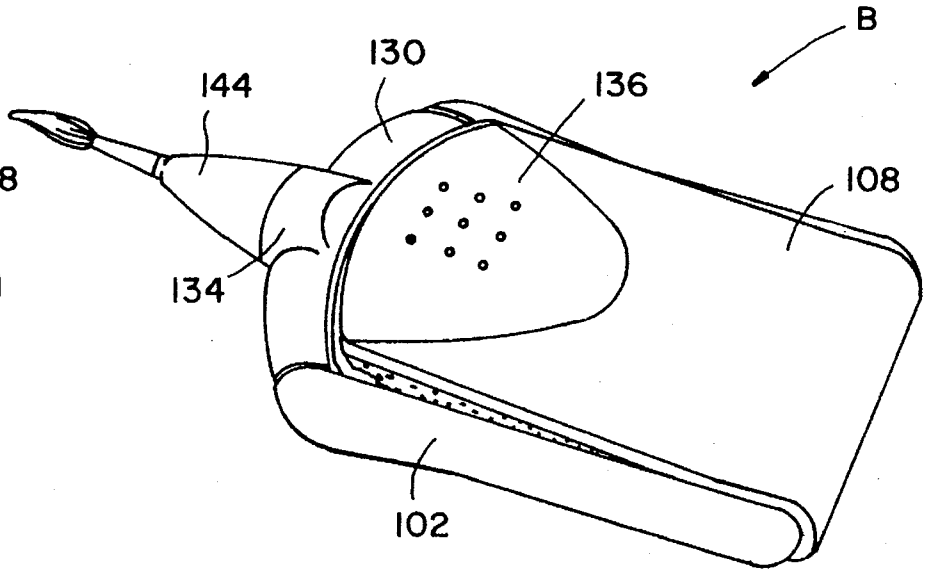
Figure 16:
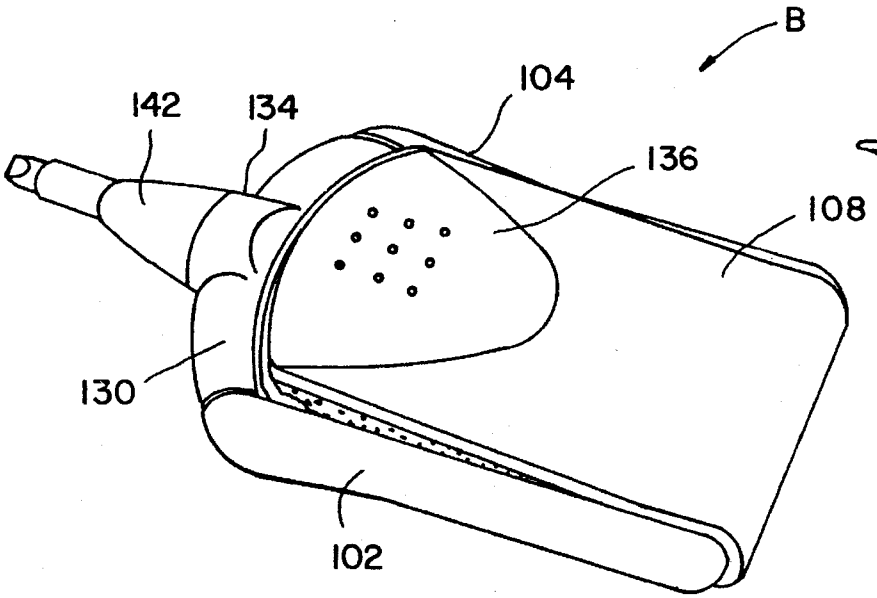

For example, in FIG. 14 the presser member is closed over a collapsible bag and upon use of manual force in area 136, paint can be dispensed through the fitting opening received in the extension 134. A fine tip marker attachment 138 is secured to the extension 134 so that paint can be dispensed in a fine, thin line. FIG. 15 illustrates a foam brush attachment 140 that connects to the extension. It, in turn, spreads ink received from the fitting opening over a wide area or strip. A broad tip marker attachment 142 is shown in FIG. 16. It provides an intermediate width of marking capability relative to the paint dispensed by the attachments 138, 140 of FIGS. 14 and 15. Unless noted to the contrary, the dispensing apparatus is otherwise identical in structure and operation. A paint brush attachment 144 is shown in FIG. 17 and, once again, operates in substantially the same manner as the embodiments described above.

Figure 18:
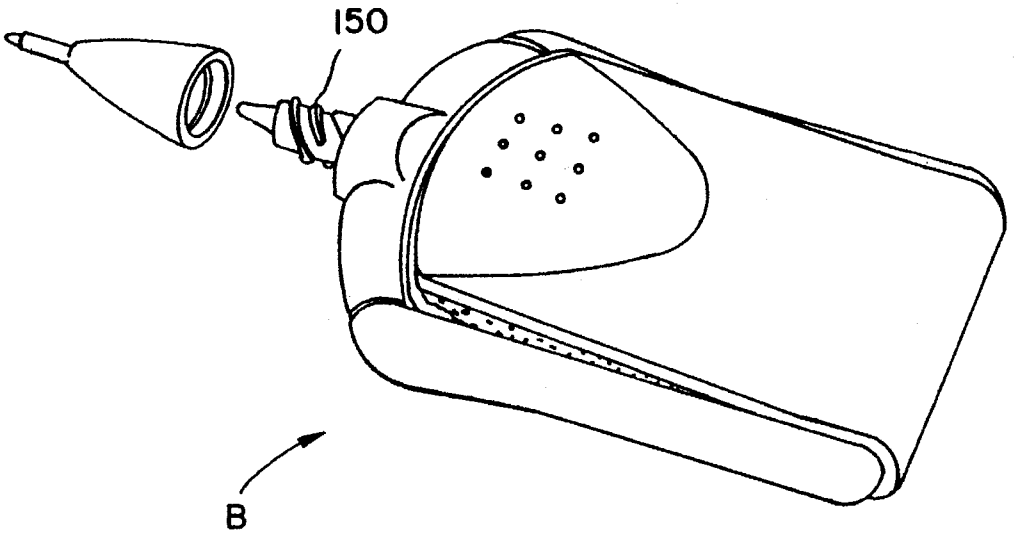
FIG. 18 illustrates an alternative arrangement for securing different attachments to the dispensing apparatus.

FIG. 18 discloses that the extension 134 may also include a helical thread 150 that facilitates connecting and disconnecting the attachment assemblies 138, 140, 142, 144 to the dispensing apparatus. Each of the attachments would likewise include a cooperating thread (not shown) on an interior portion so that the attachments could be easily secured to and removed from the head of the dispensing apparatus as desired.

Figure 19:
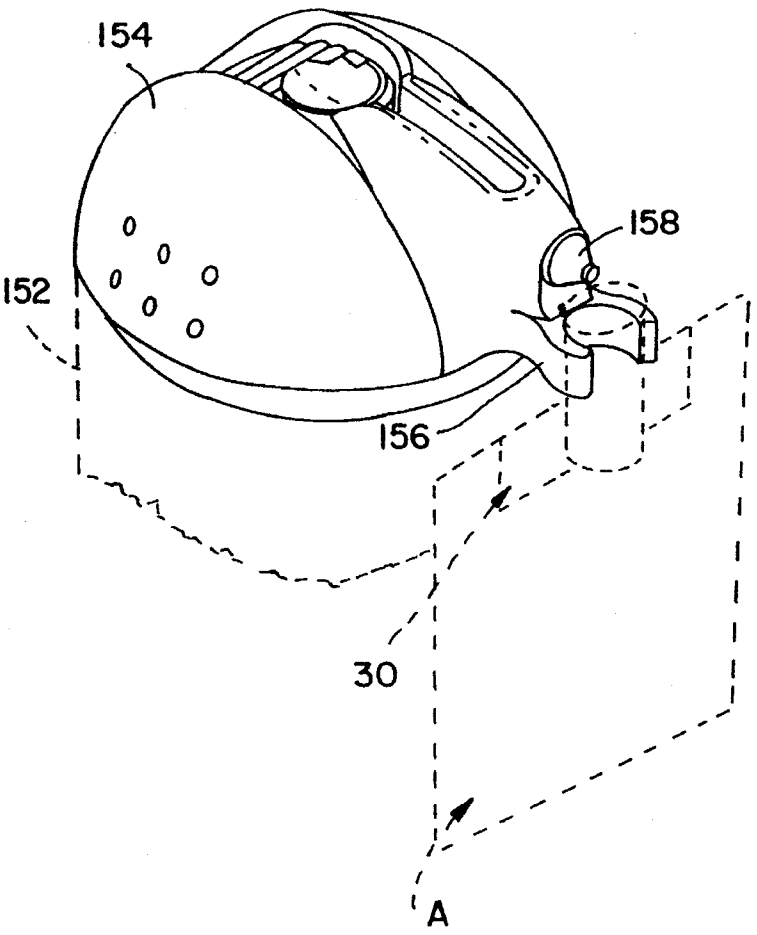
FIG. 19 is a perspective view of a collapsible paint pouch of the subject invention used in a propellant based spray arrangement.

FIG. 19 is a perspective view illustrating the adaptability of the paint pouch to a propellant assembly. A pressurized propellant is stored in casing 152 to which a main cap body 154 is secured. A generally C-shaped clamp 156 extends from the cap body and receives the fitting 30 of a collapsible pouch A. Propellant is directed out of nozzle 158 in the cap and intermixes with the paint dispensed through the fitting opening to form an effective spray assembly.

Figure 21:
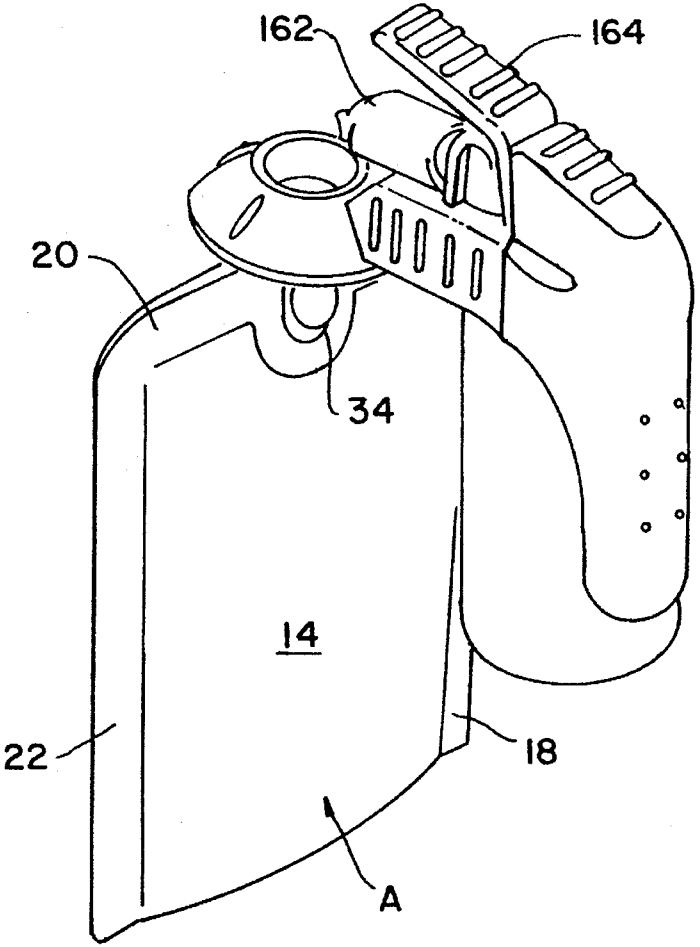
FIG. 21 is a perspective view of an alternative propellant based spray arrangement.
Figure 20:
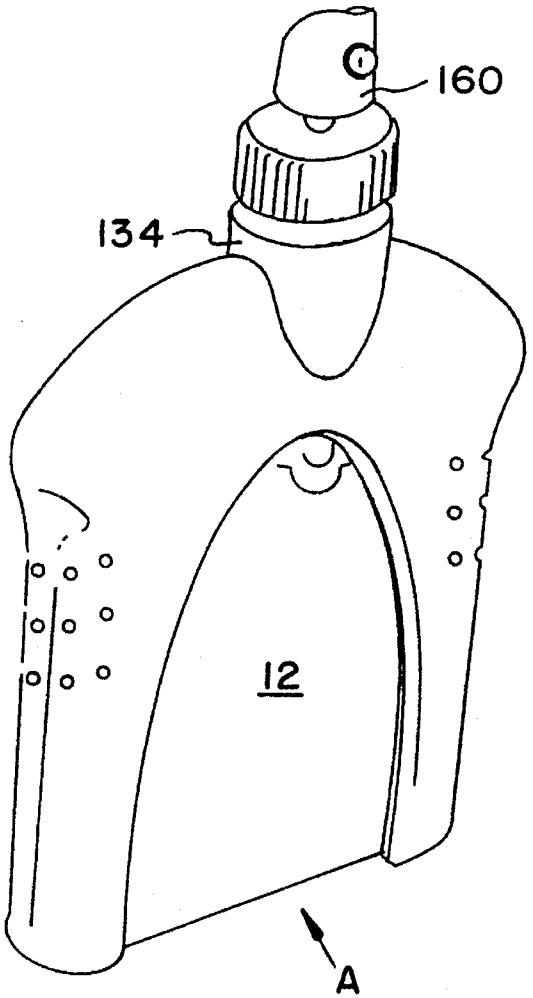
FIG. 20 is a perspective view of a pump spray apparatus used with the collapsible paint pouch.

A manual push pump assembly is shown in FIG. 20. Here, the dispensing apparatus described in FIGS. 13–18 is modified by eliminating the presser member. Instead, depression of spray nozzle 160 draws paint from the fitting opening of the pouch and directs it toward the surface to be painted. A pressurized canister of reduced size is shown in FIG. 21. There, the pressurized propellant is directed out of nozzle 162 by depressing lever 164. The paint is then intermixed with the propellant for application to a work surface (not shown).

Figure 22:
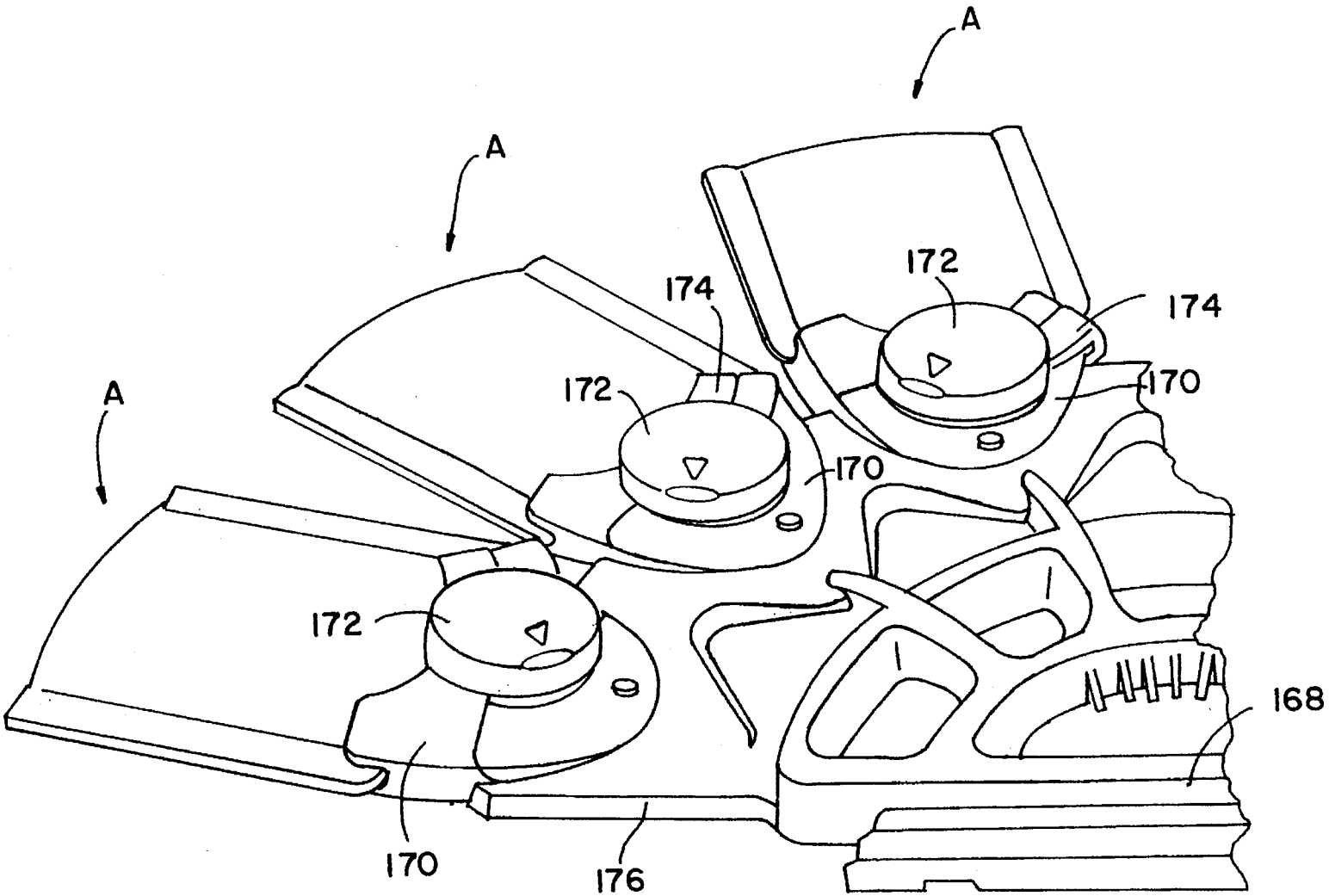
FIG. 22 is a perspective view of the collapsible pouch as used in an artist's pallet.

FIG. 22 illustrates an artist's palette 168 that employs the collapsible pouch assembly A of the present invention. A series of paint wells 170 are secured to the fittings of individual pouch assemblies. Each well includes a cap 172 that is attached by means of a flexible tether 174 to the well structures so that they are not inadvertently misplaced. Moreover, the entire well secured onto each flexible pouch may be removed from C-shaped recesses 176 formed in the pallet so that different colors may be stored on the pallet as desired, or a replacement pouch assembly easily secured thereto.

Figure 23:
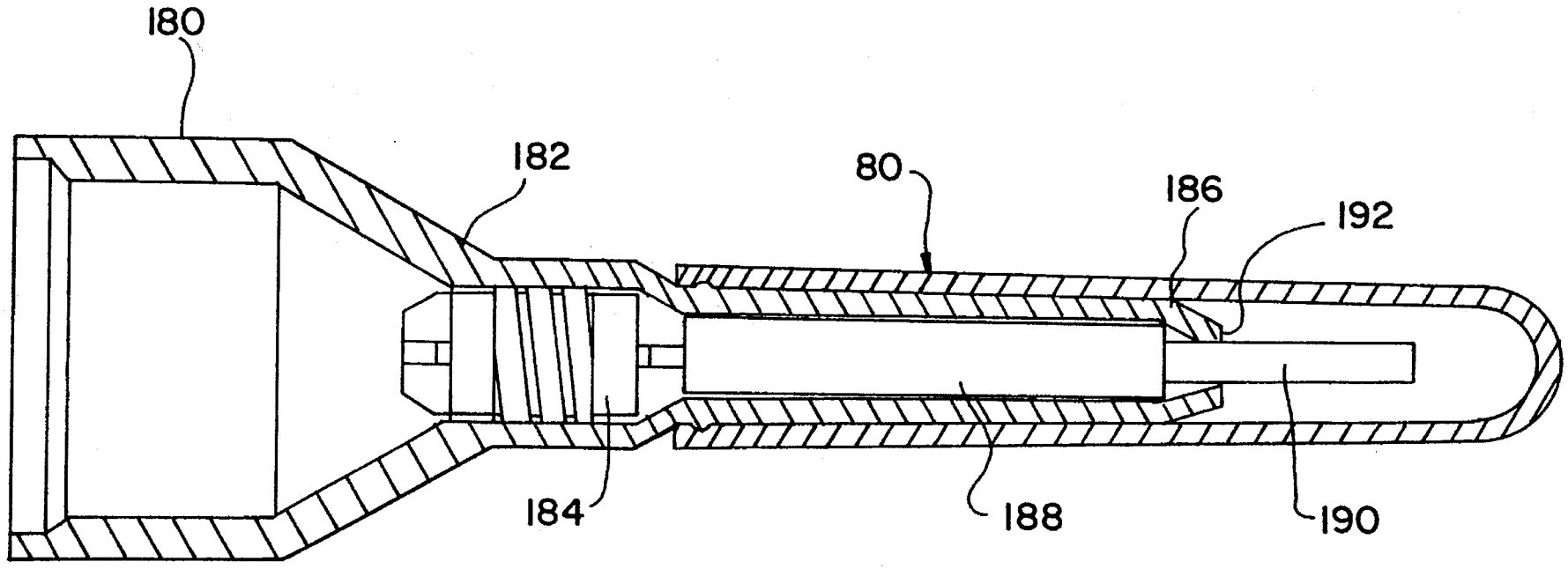
FIG. 23 is a longitudinal cross-section of a preferred attachment for supplying paint to a brush tip.

Common problems associated with attachments for supplying paint to a brush tip are that either too little or too much paint flows from the nozzle or tip resulting in inconsistent application. Shown in FIG. 23 is a preferred design of attachment assembly that includes an elongated tip 180 adapted for connection to the head of the dispensing apparatus as described above. At a reduced area 182 of the tip, a flow restrictor 184 is inserted. The flow restrictor has a helical conformation on its external surface that controls the flow of paint to a remote end 186 of the tip. The restrictor is closely received in an intermediate diameter portion of the tip and is connected at an inner end to a barrel Lee of a brush tip 190. The barrel is dimensioned for close receipt in the elongated portion of the tip so that a reservoir of paint can build up behind the entrance aperture 192. The close fit between the entrance aperture and the brush pinches the brush as it extends outwardly from the tip and paint passes outwardly through the bristles of the brush for use. This preferred structure provides a smooth, continuous flow of paint to the brush for a more consistent application of paint to the work surface.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A paint pouch assembly for dispensing a fluid therefrom, the assembly comprising:

an elongated, bag-like pouch defined by facing sidewalls sealed to one another along their periphery to form an internal cavity; and a fitting defining an outlet and having a first passage disposed substantially along a centerline of the pouch and a second passage disposed substantially perpendicular to the first passage, the second passage being interposed between the cavity and the first passage and terminating in an inlet within the cavity that is substantially parallel to the sidewalls whereby pressing a sidewall portion against the inlet shuts off fluid flow to the passages.

2. The paint pouch assembly as defined in claim 1 further comprising a removable cap for selectively opening and closing the fitting outlet.

3. The paint pouch assembly as defined in claim 1 wherein the fitting includes a planar portion at least partially sealed between peripheral portions of the sidewalls and the first passage being formed along one side of the planar portion.

4. The paint pouch assembly as defined in claim 1 further comprising a dispensing apparatus having a support surface dimensioned for receipt of the pouch thereon, a head mounted to one end of the support surface for receiving the fitting outlet therein, and a presser member mounted to the support surface for squeezing the sidewalls, of the pouch together and dispensing fluid through the fitting.

5. The paint pouch assembly as defined in claim 1 further comprising a tapered surface on the presser member for progressively urging fluid from one end of the pouch to the outlet.

6. The paint pouch assembly as defined in claim 1 further comprising a resilient, compressible member interposed between the pouch and the presser member.

7. The paint pouch assembly as defined in claim 1 wherein the fitting includes a thin-walled planar member sealingly received between facing surfaces of the sidewalls along a peripheral edge thereof, the fitting including a housing having the first passage disposed on one side of the fitting for communicating with the pouch cavity, the first passage extending generally parallel to the planar portion and the second passage being non-aligned and angularly disposed relative to the first passage for entry into the cavity; and a removable cap selectively cooperating with an end of the passage first portion for closing communication with the cavity.

8. The paint pouch assembly as defined in claim 7 wherein one of the sidewalls includes a cutout extending inwardly from a peripheral portion for receiving the fitting housing.

9. The paint pouch assembly as defined in claim 7 wherein the pouch sidewalls are formed from a single piece of generally rectangular material that is folded along a central fold line and sealed along three remaining edge portions.

10. The paint pouch assembly as defined in claim 9 wherein the material includes second and third fold lines generally parallel to the central fold line whereby the sidewalls can expand outwardly when filled with fluid.

11. The paint pouch assembly as defined in claim 7 wherein the planar member of the fitting has a first edge that generally terminates at a sealed peripheral portion of the sidewalls.

12. The paint pouch assembly as defined in claim 7 wherein the housing extends outwardly from a peripheral portion of the sidewalls.

13. The paint pouch assembly as defined in claim 7 wherein the housing includes a raised portion on an external surface thereof that provides an interference fit with the cap.

14. The paint pouch assembly as defined in claim 7 wherein the cap has a planar member with a housing mounted on one face thereof so that when the cap is located in closing relation with the fitting housing, the planar member is disposed in substantially the same plane as the fitting planar member.

15. The paint pouch assembly as defined in claim 14 wherein the cap planar member includes an opening therethrough so that the paint pouch assembly is adapted to be hung from a merchandise display unit.

* * * * *